US009347259B2

(12) United States Patent
Ferguson

(10) Patent No.: US 9,347,259 B2
(45) Date of Patent: May 24, 2016

(54) PORTABLE PRIVACY ARRANGEMENT FOR USERS OF PUBLIC RESTROOMS

(71) Applicant: Anissa Ferguson, Brandywine, MD (US)

(72) Inventor: Anissa Ferguson, Brandywine, MD (US)

( * ) Notice: Subject to any disclaimer, the term of this patent is extended or adjusted under 35 U.S.C. 154(b) by 0 days.

(21) Appl. No.: 14/444,052

(22) Filed: Jul. 28, 2014

(65) Prior Publication Data

US 2016/0024839 A1 Jan. 28, 2016

(51) Int. Cl.

| | |
|---|---|
| ***E04H 1/12*** | (2006.01) |
| ***E06B 9/24*** | (2006.01) |
| ***A47K 17/00*** | (2006.01) |

(52) U.S. Cl.
CPC . *E06B 9/24* (2013.01); *A47K 17/00* (2013.01); *E04H 1/1216* (2013.01)

(58) Field of Classification Search
USPC ..... 160/368.1, 354, 327
IPC ..... E04H 1/1216
See application file for complete search history.

(56) References Cited

U.S. PATENT DOCUMENTS

| | | | | |
|---|---|---|---|---|
| 3,480,069 | A * | 11/1969 | Handwerker | 160/354 |
| 4,799,728 | A * | 1/1989 | Akers et al. | 296/136.04 |
| 4,845,892 | A * | 7/1989 | Pinto | 49/383 |
| 4,893,668 | A * | 1/1990 | Nomura | 160/327 |
| 5,123,223 | A * | 6/1992 | Makarevich et al. | 52/311.1 |
| 5,244,245 | A * | 9/1993 | Kashino | 296/136.11 |
| 5,632,318 | A * | 5/1997 | Wang | 160/370.21 |
| 5,937,452 | A | 8/1999 | Brewer | |
| 6,308,474 | B1 * | 10/2001 | Wilson | 52/202 |
| 6,374,432 | B1 | 4/2002 | Morris | |
| 6,393,637 | B1 | 5/2002 | Hoffman | |
| 6,840,254 | B1 | 1/2005 | Windham | |
| 7,185,375 | B1 | 3/2007 | Movsas | |
| 7,464,983 | B1 | 12/2008 | Acosta et al. | |
| 8,286,688 | B2 * | 10/2012 | Crozier | 160/370.21 |
| 8,627,610 | B1 * | 1/2014 | Crowther | 52/32 |
| 2010/0116447 | A1 * | 5/2010 | Thompson | 160/368.1 |
| 2013/0074997 | A1 * | 3/2013 | Jones et al. | 150/101 |
| 2013/0089698 | A1 * | 4/2013 | Perales | 428/99 |

* cited by examiner

*Primary Examiner* — David Purol
(74) *Attorney, Agent, or Firm* — Bacon & Thomas, PLLC

(57) ABSTRACT

A portable arrangement is provided for ensuring privacy during use of a public toilet. The arrangement includes a screen in the form of a generally rectangular or square piece of sheet material with an embedded suction cup or other attachment means at each corner. Secured to the screen is a smaller pouch into which the screen can be folded for transport.

14 Claims, 4 Drawing Sheets

PORTABLE PRIVACY ARRANGEMENT FOR USERS OF PUBLIC RESTROOMS

BACKGROUND OF THE INVENTION

1. Field of the Invention

The invention relates to a portable arrangement for ensuring privacy during use of a public toilet. The arrangement includes a screen in the form of a generally rectangular or square piece of sheet material with an embedded suction cup or other attachment means at each corner. Secured to the screen is a smaller pouch into which the screen can be folded and secured by a zipper for transport.

The sheet material is dimensioned to extend across the width of the door of a public restroom stall, to cover a substantial part of the vertical gaps, openings, or slots formed between walls of the stall and vertical edges on each side of the door, and to be held in position by adhesion of the suction cups to the walls of the stall, so as to ensure that the occupant of the stall cannot be viewed through the vertical openings by a person standing outside the stall.

2. Description of Related Art

The privacy arrangement of the invention is especially suitable for use by any individual who desires greater privacy than is provided by a typical public restroom stall.

Although individuals may desire additional privacy for a variety of reasons, there is an especially critical need for such additional privacy in the case of individuals who have had abdominal surgery and are required to use a colostomy bag. Use of a colostomy bag entails frontal exposure that can easily be viewed through the gap between the door and walls of the toilet stall, and that can cause the individual to avoid use of public toilets, limiting movement or participation in activities by the individual away from home.

It is known to provide privacy screens for portable bathroom assemblies or urinals of type designed for outdoor activities such as campouts, as disclosed in U.S. Pat. Nos. 5,937,452, 6,374,432, and 7,185,375, but the screens entirely surround the bathroom assembly or urinal, and are not suitable for protecting privacy in a conventional fixed bathroom stall.

It is also known to provide portable screen structures that serve as dressing rooms, the screen structure having a door through which an individual enters, and which either entirely surrounds the individual or encloses three sides of the individual, the fourth side being shielded by a structure or vehicle, to provide privacy when changing clothes, as disclosed in U.S. Pat. Nos. 6,840,254 and 7,464,983. Such structures are too large to be easily carried during everyday activities, and cannot be used to provide privacy in a public bathroom stall.

Finally, it is also known to provide a personal cover that fold into a pouch, as disclosed in U.S. Pat. No. 6,393,637, but the personal cover is in the form of a sleeping bag or poncho, and cannot be used as a privacy screen in a public restroom stall.

Each of the above-described prior art privacy screens is designed to substantially surround a person and/or a bathroom assembly or urinal, and therefore insufficiently portable to carry around during daily activities such as shopping or dining out. Furthermore, none is suitable for ensuring privacy in public bathroom stalls, in which only the gaps between the door and walls of the stall need to be screened.

SUMMARY OF THE INVENTION

It is accordingly an objective of the invention to provide an arrangement for ensuring privacy in public restroom stalls, by ensuring that a user of the stall cannot be seen from outside the stall.

This objective is achieved, in accordance with the principles of a preferred embodiment of the invention, by a privacy arrangement that includes a screen in the form of a generally rectangular or square piece of sheet material with an embedded attachment means at each corner. Secured to the screen is a smaller pouch into which the screen can be folded and secured by a zipper, or other fasteners such as buttons, snaps, or Velcro™, for transport.

The attachment means may be in the form of a suction cup provided at each corner of the sheet material, although those skilled in the art will appreciate that other attachment means may be substituted for one or more of the suction cups, or provided in addition to the suction cups, such as magnets or hooks that engage the tops of the walls and door of the stall.

The sheet material is preferably a lightweight, easily foldable material that is sufficiently opaque as to protect the privacy of a user of the stall when the material is placed over the openings or gaps between the door and walls of the stall, and secured to the stall by the suction cups or other attachment means. Perfect opacity is not necessarily required, so long as the material provides a screening effect that prevents a person outside the stall from recognizing or perceiving activities and persons within the stall. A suitable lightweight and sufficiently opaque material is nylon, although the invention is not to be limited to a particular material.

The dimensions of the sheet material are important in that the material must have sufficient length to extend over the gaps or openings at each side of the bathroom stall door, and sufficient width to cover enough of the length of the gaps or openings to provide a requisite degree of privacy. Exemplary dimensions of the sheet material are 5'×5', although these dimensions may be varied without departing from the scope of the invention so long as the length is greater than the width of a bathroom stall door and the height is sufficient to prevent viewing by standing, or possibly standing and crouching, persons of different heights. A standard bathroom stall door is 58" high, but doors are also available in the range from 48" to 70" (see, e.g., www.allpartitions.com/doors1.html), while door widths typically range from 20" to 48" (the Americans with Disabilities Act (ADA) sets a minimum door opening width of 36" and stall width of 60" for stalls accessible to the disabled. Based on these dimensions, the sheet material of the invention should not be limited to 5'×5', but rather may be varied substantially, so long as the sheet is capable of covering gaps on either side of the stall door and has sufficient height to ensure privacy. For the U.S., a minimum length of greater than 30 inches, and a minimum height of 48 inches, appears to be desirable, though these minimum dimensions may be different in other countries and may also change to meet legal requirements such as changes in the ADA or local rules. Those skilled in the art will appreciate that the screen need not be perfectly rectangular or square so long as it is capable of extending over the width of the door and covering the gaps between the door and the walls of the stall.

According to the preferred embodiment of the invention, the privacy screen includes a pouch into which the screen can be folded when not in use. The pouch is secured to or integrated with the screen so that the pouch is immediately available when stall activities have concluded, at which time the screen can simply be folded and tucked into the pouch. A closure, such as a zipper extending along three edges of the pouch, is provided to secure the screen within the pouch for transport, and a strap may be provided to facilitate carrying. The dimensions of the pouch are selected for portability, for example so that the pouch can be carried in a woman's purse or a jacket pocket. Suitable dimensions are 6"×1.75"×4", although these dimensions may be varied without departing from the scope of the invention.

In an especially preferred embodiment of the invention, the pouch is formed separately from the panel, and is sewn or stitched to a main panel of the screen. The main panel includes a generally rectangular or square opening that is preferably at or near a center of the main panel, the dimensions of the opening corresponding to dimensions of a side of the pouch. The pouch includes a back panel having dimensions corresponding to the dimensions of the opening, four side panels having a width corresponding to the thickness of the pouch, and a flap having dimensions corresponding to dimensions of the back panel, with one side of the flap being secured to the one of the side panels to form a hinge that allows the flap to be opened and closed. The top edges of the side panels are stitched to the panel along the edges of the opening when the flap is in the open position, so that the opening forms an opening of the pouch, such that the main panel of the screen preventing closure of the pouch. One part of a zipper is included on three edges of the opening and three edges of the flap to enable the flap to be secured to the main panel and thereby close the pouch when the main panel is folded into the pouch. According to this arrangement, the pouch is securely integrated into and inseparable from the main panel, thereby providing a convenient and readily accessible storage space into which the screen can easily be folded when the screen is not in use.

As an optional added feature, the pouch may include an additional pocket and closure for holding keys, money, and the like, eliminating the need for the user to carry a separate purse or wallet in addition to the pouch.

DETAILED DESCRIPTION OF THE PREFERRED EMBODIMENTS

Throughout the following description and drawings, like reference numbers/characters refer to like elements. It should be understood that, although specific exemplary embodiments are discussed herein there is no intent to limit the scope of present invention to such embodiments. To the contrary, it should be understood that the exemplary embodiments discussed herein are for illustrative purposes, and that modified and alternative embodiments may be implemented without departing from the scope of the present invention.

Figure 1:
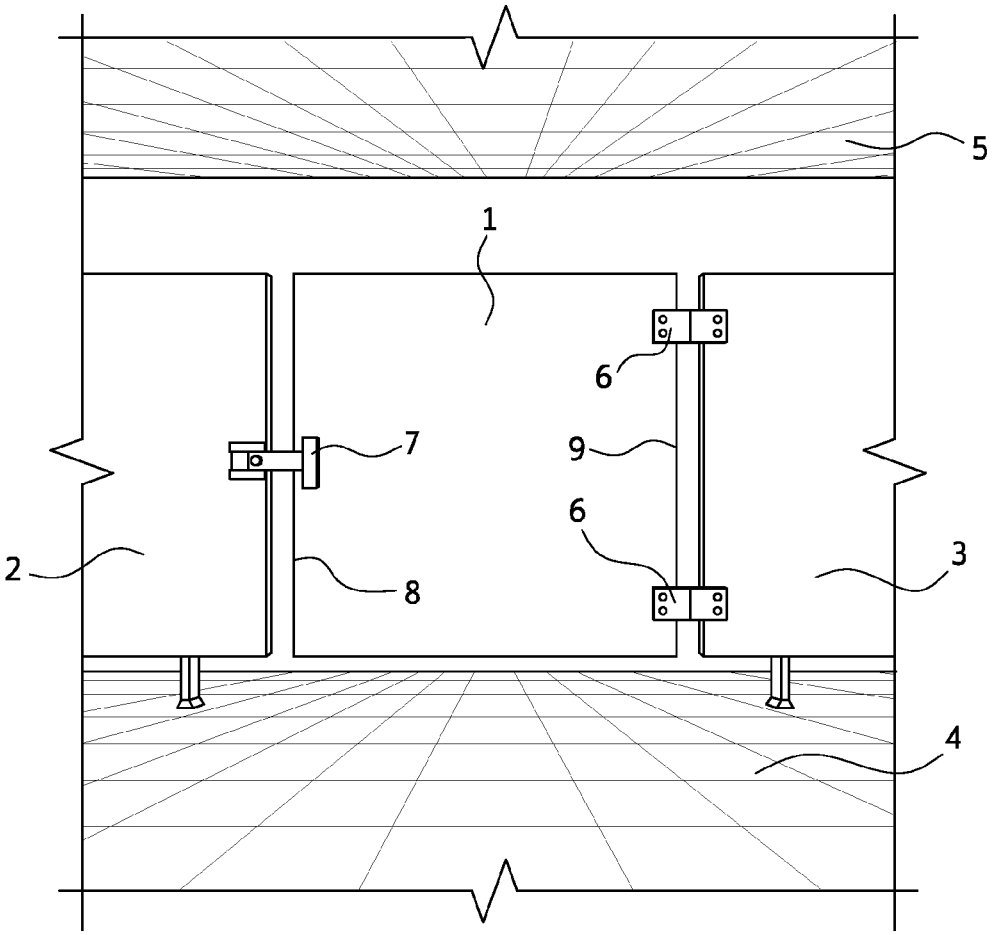
FIG. 1 shows a conventional bathroom stall door, for which the screen of the present invention may be utilized.

FIG. 1 shows a conventional bathroom stall arrangement of the type typically used in non-residential bathrooms. The illustrated stall arrangement includes stall access door 1 and portions of walls 2 and 3, all of which are typically made of a metal such as steel, and extend from a few inches above floor 4 to a height sufficient to prevent a person standing on the ground from observing the interior of the stall through the space between the ceiling 5 and the tops of the door 1 and walls 2, 3. One side of the door is attached to one of the walls 3 by hinges 6, and a latch 7 is provided on the opposite side of the door to prevent the door from being opening by pushing on the door 1 from outside the stall.

In order to enable the door 1 to be easily opened and closed, the door 1 is space from the walls 2,3 by gaps 8 and 9 on each side of the door. The gaps 8,9 may have widths of anywhere from less than a quarter inch to a half inch or more. In general, adequate privacy is provided despite the gaps so long as a person on the outside of the stall is a sufficient distance away from the stall and does not intentionally attempt to view the interior of the stall. Nevertheless, it is often possible to look through the gaps into the stall. This possibility poses a disincentive to use of public restrooms can cause substantial discomfort or stress to individuals using the stall, and particularly individuals who have an enhanced need for privacy, such as colostomy patients.

Figure 2:
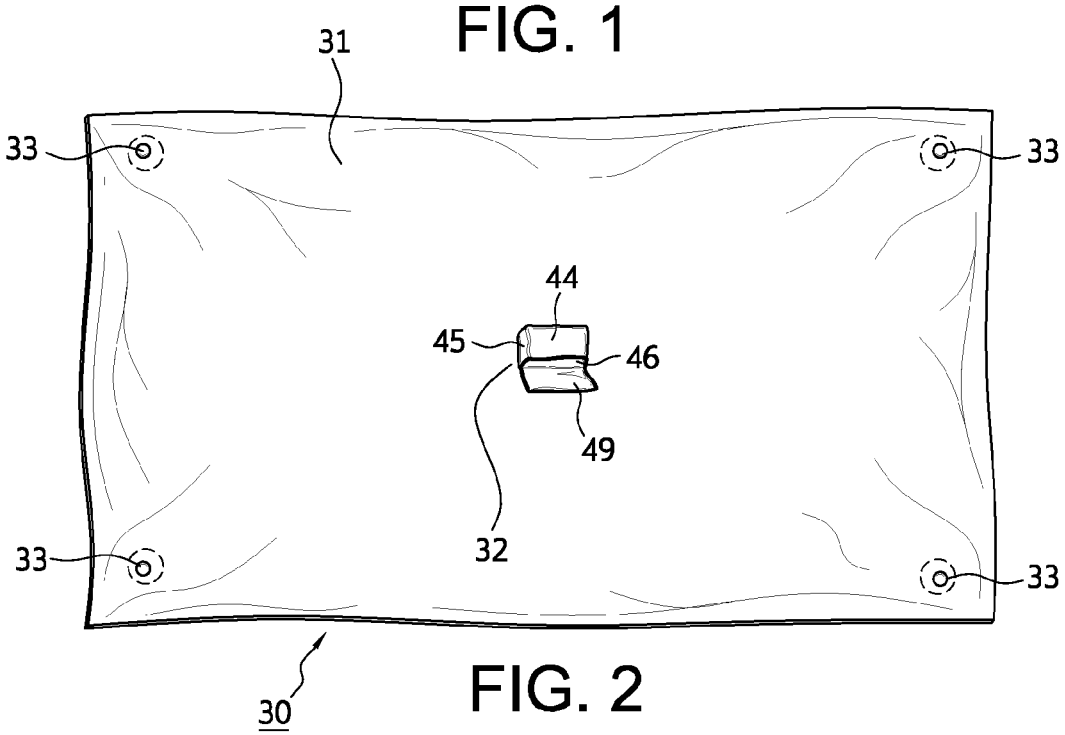
FIG. 2 is an isometric view of a privacy screen of a preferred embodiment of the invention.
Figure 3:
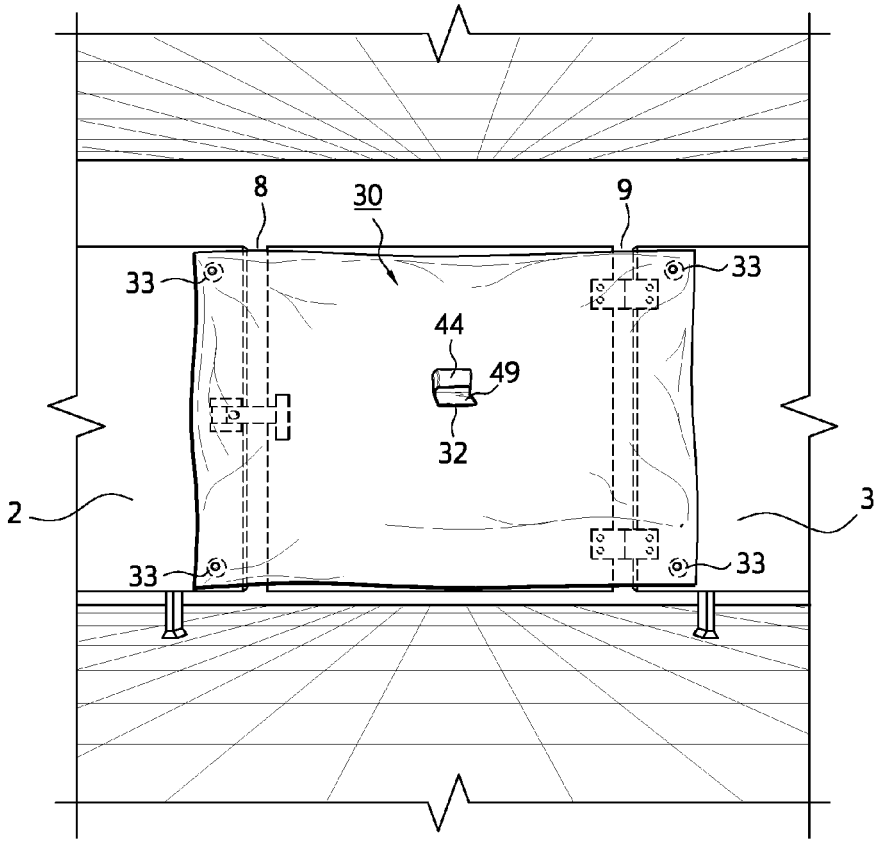
FIG. 3 shows the privacy screen of FIG. 2, after being attached to a bathroom stall of the type shown in FIG. 1

As shown in FIGS. 2 and 3, the present invention provides a screen 30 that attaches to the walls 2,3 of a stall such as the one illustrated in FIG. 1, and that covers at least the vertical gaps 8,9 between walls 2,3 and door 1. Screen 30 includes a main panel 31, a pouch 32 attached to the main panel 31, and means 33 for attaching the panel to walls 2,3 such that the screen 30 extends between the walls 2,3 and covers both vertical gaps 8,9.

The attachment means 33 may be in the form of suction cups provided at each corner of the sheet material, but is not limited to suction cups. Alternative attachment means include, by way of example and not limitation, hooks that engage the tops of the walls and door of the stall, or magnets sewn into pockets adjacent at least two corners of the screen 30.

The screen 30 is preferably made of a lightweight, easily foldable sheet material that is sufficiently opaque as to protect the privacy of a user of the stall when the material is placed over the openings or gaps between the door and walls of the stall, and secured to the stall by the suction cups or other attachment means. Perfect opacity is not necessarily required, so long as the material provides a screening effect that prevents a person outside the stall from recognizing or perceiving activities and persons within the stall. A suitable lightweight and sufficiently opaque material is a finely woven nylon mesh, although the invention is not to be limited to a particular material.

The screen 30 must have sufficient length to extend over the vertical gaps 8,9 or openings at each side of the bathroom stall door 1, and sufficient width to prevent persons from peering over or under the screen in order to see into the stall. Exemplary dimensions of the sheet material are 5'×5', although these dimensions may be varied without departing from the scope of the invention so long as the length is greater than the width of a bathroom stall door, including stall doors for the disabled, which must be wide enough to admit wheelchairs. The vertical extent or height of the screen must be sufficient to prevent viewing by standing, or possibly standing and crouching, persons of different heights. For the U.S., a minimum length of greater than 30 inches, and a minimum height of 48 inches, is preferred, although these minimum dimensions may be different in other countries and may also change to meet legal requirements such as changes in the ADA or local rules.

FIGS. 4-7 show a specific exemplary implementation of the privacy screen of FIGS. 2 and 3, including details of the construction of the privacy screen 30 and the manner in which a main panel 41 of the privacy screen may be folded into the integral pouch 40 for transport. The pouch 40 is secured to or integrated with the screen 30 so that the pouch is immediately available when stall activities have concluded, at which time the screen can simply be folded and tucked into the pouch. A closure, such as a zipper 42 extending along three edges of the pouch, is provided to secure the screen within the pouch for transport, and a strap 43 may be provided to facilitate carrying. The dimensions of the pouch are selected for portability, for example so that the pouch 40 can be carried in a woman's purse or a jacket pocket. Suitable dimensions are 6"×1.75"×4", although these dimensions may be varied without departing from the scope of the invention.

Figure 4:
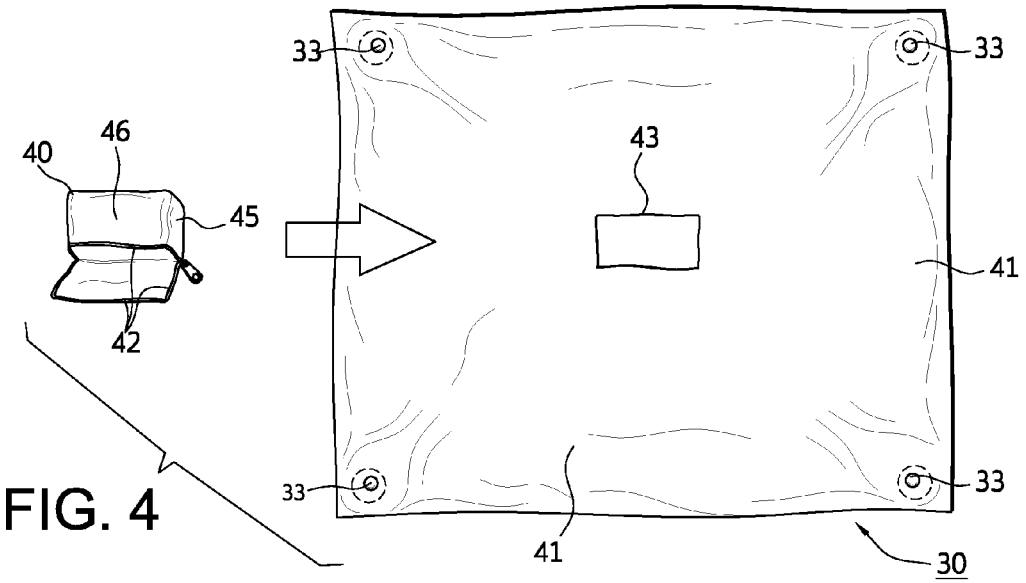
FIG. 4 is an isometric view of a pouch and main panel, which are to be assembled together to form a screen according to a preferred embodiment of the invention.
Figure 5:
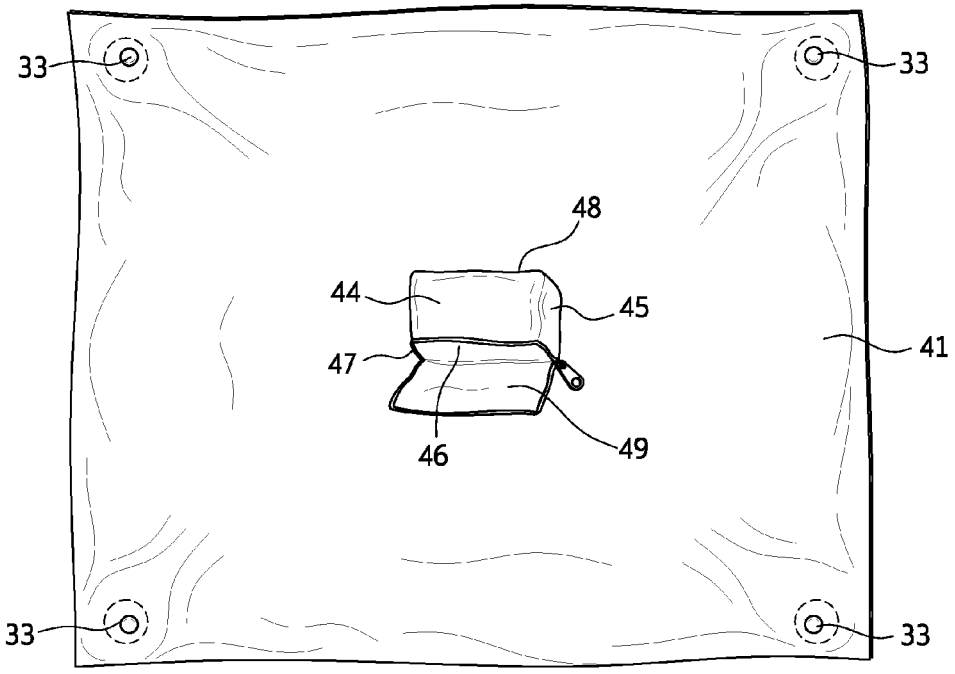
FIG. 5 is an isometric view of the pouch and main panel of FIG. 4, after assembly to form a privacy screen.

As illustrated in FIG. 4, the pouch 40 is formed separately from the main panel 41, and is then sewn, stitched, or otherwise attached to the main panel 41, as illustrated in FIG. 5. In addition to or instead of stitching, the pouch may be attached by fabric glue, rivets, or any other fastening means. The material of the pouch 40 is preferably the same as that of the main panel 41, although it is within the scope of the invention to make the pouch of a different material, such as vinyl, cloth, or leather, in order to provide a more attractive carrying case and/or provide environmental protection for the main panel 41 stored inside the pouch.

Figure 7:
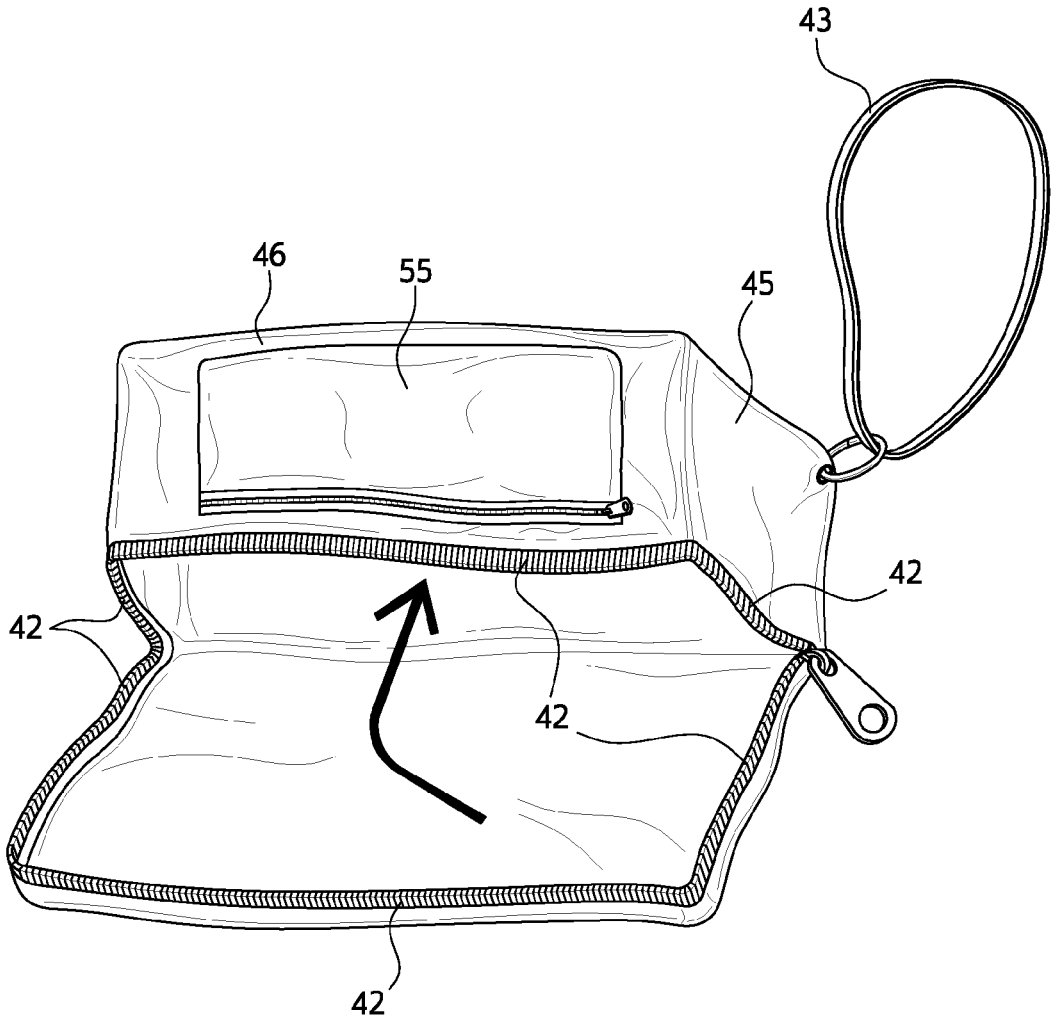
FIG. 7 is an isometric view of the pouch of FIGS. 3-6, after the main panel has been folded into the pouch.

The main panel 41 includes a rectangular opening 43 that is preferably at or near a center of the main panel, the dimensions of the opening 43 corresponding to dimensions of a back panel 44 of the pouch. As best seen in FIG. 7, the pouch 40 includes the back panel 44 having dimensions corresponding to the dimensions of the opening 43, four side panels 45-48 having a width corresponding to the thickness of the pouch, and a flap 49 having dimensions corresponding to dimensions of the back panel 44 to form a parallelepiped shaped container, with one side of the flap 49 being secured to the one of the side panels 45 to form a hinge 50 that allows the flap 49 to be opened and closed. The top edges 51 of the side panels are stitched or otherwise attached to the panel along the edges 52 of the opening 43 when the flap 49 is in the open position, so that the opening 43 forms an opening of the pouch, and such that the main panel 41 of the screen prevents closure of the pouch until the main panel has been folded into the pouch. One mating half of zipper 42 is included on three edges of the opening, while the other mating half of zipper 42 extends along the three edges of the opening 43 to enable the 49 flap to be secured to the main panel 41 and thereby close the pouch when the main panel 41 is folded into the pouch 40.

As an optional added feature, shown in FIG. 7, the pouch may include an additional pocket 55 for carrying items such as cash, bank cards, keys, and other items that would normally be carried in a purse or wallet. The additional pocket is preferably accessible from outside the pouch when the screen is enclosed within the pouch, and may be secured by a separate closure such as a zipper. The pocket could be sewn into back panel 44, side panels 45-48, or flap 49.

Figure 6:
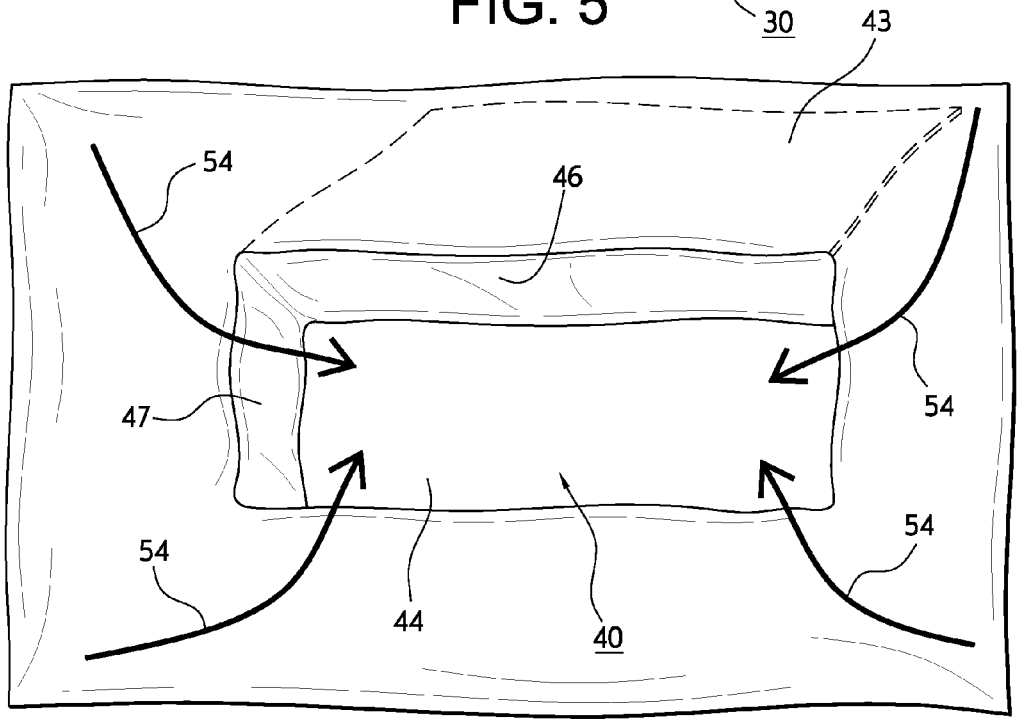
FIG. 6 is an isometric view of the reverse side of the privacy screen of FIG. 4, illustrating the manner in which the main panel is folded into the pouch after use.

FIG. 6 shows the reverse side of the arrangement of FIG. 5, with arrows 54 indicating in schematic fashion the manner in which the edges of the main panel are folded into the pouch 40 before closure, although it will be appreciated that the main panel 41 may be folded multiple times before being positioned in the pouch. The main panel 41 may include creases (not shown) or other guides to facilitate folding. FIG. 7 shows the pouch 40 after the main panel 41 has been folded into the opening 43 and before the flap 49 has been secured to the pouch by the zipper 42. It will be appreciated that the zipper 42, as well as the zipper of the optional pocket 50, may be replaced by other closure elements, such as buttons, snaps, or Velcro™.

What is claimed is:

1. A privacy arrangement for public restroom stalls, comprising:

a screen in the form of a generally rectangular or square piece of sheet material with an embedded attachment means at each corner, the attachment means being for attaching the corners of the screen to the restroom stall in such a way that the screen extends over the door and gaps between the door and walls of the stall, to cover the gaps and prevent a person outside the stall from viewing a person inside the stall through the gaps; and a smaller pouch into which the screen is folded and secured by at least one closure for transport, wherein the pouch is secured to or integrated with the screen so that the pouch is immediately available when the screen when stall activities have concluded, at which time the screen can simply be folded and tucked into the pouch, and wherein the screen includes a main panel with an opening, the pouch includes a back panel having dimensions corresponding to dimensions of the opening, four side panels extending from the back panel to form five sides of an open, generally parallelepiped shape container, and a flap secured to or integral with a top edge of one of the side panels to form a hinge, said flap having dimensions of said openings, wherein top edges of each of the side panels are secured to areas of the side panel adjacent four sides of the opening when the flap is in an open position.

2. A privacy arrangement as claimed in claim 1, wherein the attachment means includes suction cups provided at each corner of the sheet material.

3. A privacy arrangement as claimed in claim 1, wherein the sheet material is a lightweight, easily foldable material that is sufficiently opaque as to protect the privacy of a user of the stall when the material is placed over the openings or gaps between the door and walls of the stall, and secured to the stall by the attachment means.

4. A privacy arrangement as claimed in claim 1, wherein the sheet material is a nylon mesh.

5. A privacy arrangement as claimed in claim 1, wherein the sheet material has a sufficient length to extend over the gaps at each side of the bathroom stall door, and sufficient width to cover at least a substantial portion of the vertical extent of the gaps.

6. A privacy arrangement as claimed in claim 5, wherein the sheet material is at least 30"×48".

7. A privacy arrangement as claimed in claim 6, wherein the sheet material is approximately 5'×5'.

8. A privacy arrangement as claimed in claim 1, wherein mating parts of a closure extend around the three edges of the flap and tops of three of the side panels other than the side panel that includes the hinge.

9. A privacy arrangement as claimed in claim 8, wherein the closure is a zipper.

10. A privacy arrangement as claimed in claim 1, further comprising a closure for securing the screen within the pouch for transport.

11. A privacy arrangement as claimed in claim 10, wherein the closure is a zipper extending along three edges of the pouch.

12. A privacy arrangement as claimed in claim 1, wherein the pouch is small enough to fit within a woman's purse or a jacket pocket.

13. A privacy arrangement as claimed in claim 1, wherein the pouch is small enough to fit within a woman's purse or a jacket pocket.

14. A privacy arrangement as claimed in claim 1, wherein the pouch further includes a closeable pocket in a back panel or flap of the pouch for storing items other than the screen.

* * * * *